United States Patent [19]

Morrison

[11] 4,388,017

[45] Jun. 14, 1983

[54] TROWELING BLADE ROTOR ASSEMBLY

[76] Inventor: Donald R. Morrison, 6228 Eagle Peak Dr., Charlotte, N.C. 28214

[21] Appl. No.: 325,276

[22] Filed: Nov. 27, 1981

[51] Int. Cl.[3] ..... E01C 19/22

[52] U.S. Cl. ..... 404/112

[58] Field of Search ..... 404/112; 15/250.34, 15/250.35, 250.31

[56] References Cited

U.S. PATENT DOCUMENTS

| | | | |
|---|---|---|---|
| 2,351,278 | 6/1944 | Mathews | 404/112 |
| 3,259,033 | 7/1966 | Kelley | 404/112 |
| 3,402,647 | 9/1968 | Colizza | 404/112 X |
| 3,412,657 | 11/1968 | Colizza | 404/112 |
| 3,791,754 | 2/1974 | Zochil | 404/112 |

*Primary Examiner*—Nile C. Byers, Jr.
*Attorney, Agent, or Firm*—B. B. Olive

[57] ABSTRACT

An improved concrete troweling blade rotor assembly of the type in which the blades rotate unidirectionally and do not tilt around the blade support axis is provided with means enabling the blade support arms to be independently adjusted with respect to an inner, transverse, horizontal axis passing through each support arm to compensate for machine wear.

1 Claim, 3 Drawing Figures

TROWELING BLADE ROTOR ASSEMBLY

DESCRIPTION

CROSS-REFERENCE TO RELATED APPLICATON

The present invention relates to applicant's copending application Ser. No. 132,636, filed Mar. 21, 1980, entitled "Motor Powered Rotary Trowel".

TECHNICAL FIELD

The invention relates to motor powered trowels for smoothing concrete and specifically to an improved rotary assembly for such trowels.

BACKGROUND ART

It is known to incorporate means in a power-operated trowel enabling blades to be tilted in either direction around the radial, horizontal axis of the respective mounting arms on which the blades are mounted in the typical motor-powered trowel. U.S. Pat. Nos. 2,351,178; 2,826,971; 3,062,107; and 3,412,657 teach various mechanical and hydraulic arrangements for adjusting the blade tilt around the radial, horizontal axis of the mounting arms.

It is also known that after a power-operated trowel has been in service for an extended time the blades will often require adjustment to change the working plane of the blades with respect to an inner horizontal transverse axis through the arms. Sometimes the operator may bend the blade mounting arm to adjust the operating plane of the blade with respect to such axis. In other instances, a temporary shim, washer, or other means, will be jammed into the blade mounting arm connection on the rotor assembly to change the plane of the blade with respect to such axis. The need to adjust the blade in this respect is particularly acute with respect to unidirectional motor-powered trowels of the type in which the blades do not tilt around the longitudinal arm axis.

With the foregoing in mind, the object of the present invention is that of providing an improved troweling blade rotor assembly having means to individually adjust the angle of the working surface of each blade with respect to an inner, transverse axis passing through the blade support arm, particularly for unidirectional motor powered trowels.

DISCLOSURE OF INVENTION

In the improved troweling blade rotor assembly of the invention, the blades mount on respective mounting arms. The mounting arms are in turn arranged in a radial arrangement on a hub member which is driven by the trowel drive shaft. The hub member receives the respective inner driven ends of the mounting arms in corresponding receptacle formations. Each radial arm has its inner end pivotally mounted for swinging about an axis transverse of the arm and parallel to the horizontal plane. The actual working plane of each blade can be adjusted with respect to the horizontal by means of an adjusting screw which controls the amount of tilt about the mentioned axis for each respective mounting arm independent of the other arms. The blades rotate in one direction.

BEST MODE FOR CARRYING OUT THE INVENTION

Figure 1:
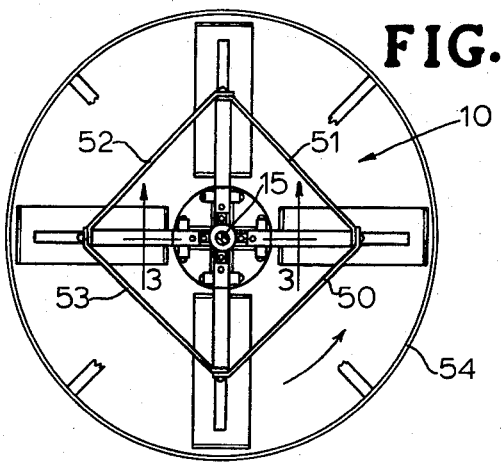
FIG. 1 is a plan view showing a plurality of troweling blades on radial mounting arms which are in turn pivotally mounted on a hub adapted to be driven by the driving shaft of the motor of a troweling machine according to the invention.
Figure 2:
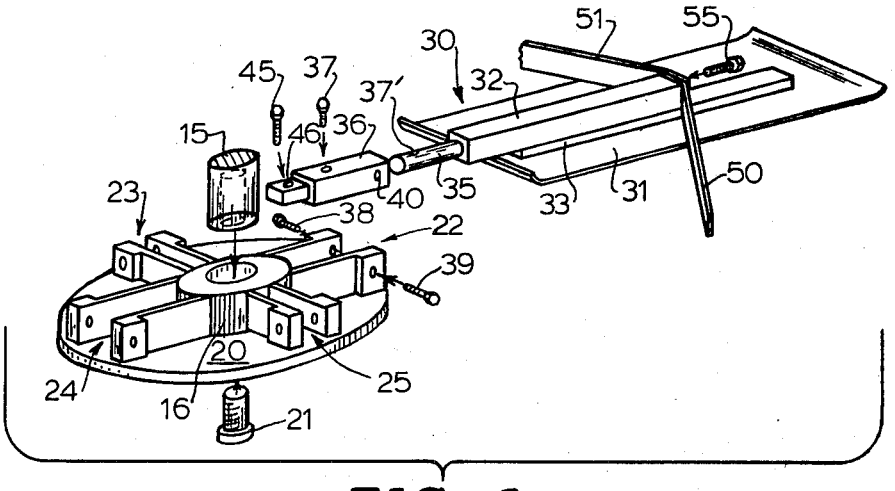
FIG. 2 is an exploded perspective view showing a troweling blade assembly with one representative blade-arm structure according to the invention.
Figure 3:
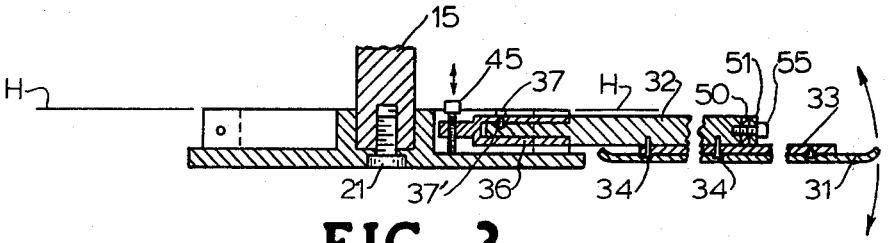
FIG. 3 is an enlarged fragmentary section view taken along line 3—3 of FIG. 1 showing how each individual blade is pivotally supported and can be tilted in its respective receptacle formation.

With reference to the drawings, the improved troweling blade rotor assembly 10 of the invention mounts on the trowel drive shaft 15 which is typically driven by a gasoline engine as a source of power for driving the trowel apparatus. A metal cast or machined hub 20 receives shaft 15 in collar 16 and is secured on shaft 15 by screw 21. In the illustrated example hub 20 incorporates four mounting arm receptacle formations 22–25. Each mounting arm assembly 30 comprises a mounting arm 32 to which is secured a support bar 33 mounting a troweling blade 31 by means of bolts 34. The inner shaft portion 35 of arm 32 fits and is secured within holder 36 by screw 37 fitted into recess 37'. Holder 36 is pivotally supported on pins 38, 39 which engage holes 40 so as to provide an axis transverse of arm assembly 30 and parallel to the horizontal about which arm 32 may pivot. Since all of the mounting arm assemblies 30 are similar only one such assembly is shown for purpose of illustration. The blades rotate within guard ring 54.

The holder 36 is designed to hold arm 32 securely and to fit snugly within the respective hub receptacle 25 to prevent rotation of arm 32 about the radial longitudinal axis extending through the mounting arm 32. Each arm 32 and holder 36 form an integral blade supporting arm means. However, an adjusting screw 45 enables mounting arm 32 to be pivoted about the transverse horizontal axis passing through pins 38, 39 by means of turning screw 45 in and out of its respective threaded hole 46 provided in holder 36. Since the entire weight of the trowel machine bears on hub 15 and since the entire weight of the machine is supported by the trowel blades 31, it can be seen that by adjusting the respective adjusting screws 45 the working surface of the various trowel blades 31 with respect to the horizontal can be easily regulated to compensate for machine wear, plane H being a reference horizontal.

To facilitate pivoting of the respective arm assemblies 30, the conventional brace arms 50–53 are made with overlapping ends and enlarged bolt holes to receive the retaining bolts 55. Thus, as machine wear is experienced each blade assembly 30 can be independently pivoted about a transverse axis at its inner end and which is parallel to the horizontal by appropriate adjustment of screws 45 and 55 as required.

I claim:

1. An improved troweling blade rotor assembly adapted for being driven by the drive shaft of a powered rotary-type trowel unidirectionally, comprising:

(a) a hub member having:

(i) a vertically-oriented, centrally-located collar for receiving the drive shaft of a rotary trowel;

(ii) integral with said collar and extending radially outward therefrom, a plurality of circumferentially spaced blade-mounting arm receptacles; and (iii) means for securing said shaft to said hub member;

(b) a plurality of radial blade mounting arms having the respective inner ends thereof pivotally mounted in respective said receptacles and pivotal only about horizontal axes passing through the respective said inner ends and oriented transverse of the respective longitudinal axes of said arms;

(c) screw adjusting means mounted on respective said inner end portions of each said mounting arm between said collar and said axes enabling the degree of tilt of said mounting arms to be individually adjusted with respect to the horizontal plane and when under the influence of the weight of said machine bearing on said collar; and (d) a trowel blade secured to each respective said arm and having the working surface thereof adjustable with respect to the horizontal plane by adjusting the respective said screw adjusting means located thereon.

* * * * *